US005546927A

United States Patent [19]

Lancelot

[11] Patent Number: 5,546,927

[45] Date of Patent: Aug. 20, 1996

[54] OVEN DOOR

[75] Inventor: Pierre Lancelot, Gommegnies, France

[73] Assignee: Eurofours S.A., France

[21] Appl. No.: 360,704

[22] PCT Filed: Apr. 29, 1994

[86] PCT No.: PCT/FR94/00496

§ 371 Date: Jan. 20, 1995

§ 102(e) Date: Jan. 20, 1995

[87] PCT Pub. No.: WO94/25802

PCT Pub. Date: Nov. 10, 1994

[30] Foreign Application Priority Data

Apr. 29, 1993 [FR] France ..... 93 05315

[51] Int. Cl.[6] ..... F24C 15/04

[52] U.S. Cl. ..... 126/194; 126/190; 126/200; 110/173 K; 110/180

[58] Field of Search ..... 126/194, 190, 126/198, 200, 545; 110/173 R, 180, 173 B

[56] References Cited

U.S. PATENT DOCUMENTS 4,638,788 1/1987 Lancelot ..... 126/190 X 4,817,585 4/1989 Craver ..... 126/194 X 5,022,380 6/1991 Faurel et al. ..... 126/190

FOREIGN PATENT DOCUMENTS 0704717 2/1915 Belgium .

0451702 8/1936 United Kingdom .

0864816 4/1961 United Kingdom .

*Primary Examiner*—Larry Jones

*Attorney, Agent, or Firm*—Ladas & Parry

[57] ABSTRACT

The oven door comprises a frame on which two panes are mounted. These two panes are parallel and spaced apart from each other. The inside pane is hinge-mounted relative to the frame by means of a hinge piece and pivatable about a hinge axis at a lateral side of the frame. Rapid-action locking and unlocking closure means, that are point spacers, are situated remote from the hinge axis of the inside pane. The spacers enable the inside pane to be held in a closed position relative to the frame. The point spacers provide rapid-action locking and unlocking the closure, and keep a space between the inside pane and the inside face of the frame when the inside pane is closed. The hinge piece includes at least one plate. The inside pane is fixed at a distance from the plate by at least one fixing point spacer in such a manner that when the inside pane is in the closed position the plate engages and bears against the inside face of the frame.

4 Claims, 3 Drawing Sheets

OVEN DOOR

The present invention relates to a double-glazed oven door which can be fitted to various types of oven as used in particular in the food industry, and more particularly on bakers' oven doors. It relates more particularly to a double-glazed oven door whose inside glass or pane is hinged.

BACKGROUND OF THE INVENTION

A first type of oven is already known, in particular from document FR 2 561 359, in which the door comprises a frame and at least one inside pane which is fixed directly to the frame of the door, being held at a distance from the frame by point fixing means of the type comprising screws or bolts acting as spacers. This first type of oven is closed in sealed manner by pressing the inside pane of the door directly against the muffle of the oven. When the door is in the closed position, the inside pane is effectively held in position at a distance from the frame of the door by the point spacers, thereby making it possible to obtain optimum sealed closure. That serves to prevent problems associated with leaks around the inside pane of the kind that are encountered in conventional oven doors in which sealed closure of the oven is obtained by causing the frame of the door to cooperate not with the inside pane, but with a gasket surrounding the opening of the oven, the inside pane being mounted in the frame of the door. The door used in this first type of oven also has the advantage of conferring very good thermal insulation to the frame relative to the inside pane, which pane is the only part of the door that comes into contact with the muffle of the oven. Thermal bridges between the inside pane and the frame are restricted to the point spacers, and the space that exists between the pane and the frame makes it possible to ventilate the inside pane and the frame. When this first type of oven includes an outside, second pane, the second pane is directly mounted in the frame of the door, for example. In which case, to gain access to the space that exists between the two panes, particularly when cleaning, it is necessary to dismount the inside pane, disconnecting it completely from the frame on which it is fixed. Such a dismounting operation requires tooling, is expensive in time, and it implies that the pane will be handled, thus running the risk of it being broken.

Elsewhere, proposals have already been made, in particular in document GB 451 702, for a second type of oven having a double-glazed door, in which one of the two panes is hinge-mounted relative to the frame of the door, and in which the door also includes means for closing the hinged pane. Said means for closing the hinged pane are suitable for rapid-action locking and unlocking and they are situated at the opposite end of the door to the hinge axis of the pane. They enable the hinged pane to be locked in a position where it is parallel to and spaced apart from the other pane. In the particular example described and shown in that document GB 451 702, the hinge-mounted pane is the outside pane. In that document, it is suggested that the hinged pane could be the inside pane. For obvious safety reasons, this second option is preferable so as to make it impossible to open the outside pane while the oven is in operation, with its door closed. The double-glazed oven door described in that document has the advantage of providing rapid and easy access to the space situated between the two panes, without requiring either of the two panes to be dismounted. Nevertheless, that door is of conventional type in that the inside pane is not designed to come into co-operation with a sealing gasket in order to close the oven hermetically, unlike the first type of oven mentioned above. The oven door therefore does not present the same advantages as oven doors of the first type mentioned above. Furthermore, if the inside pane is hinge-mounted, then it is situated inside the oven when the door is closed, and that has the result of the hinge members and the rapid-action closure means for locking and unlocking the inside pane are subjected to high levels of dirtying.

OBJECT AND SUMMARY OF THE INVENTION

The object of the Applicant is to propose a two-pane oven door which firstly includes an inside pane hinge-mounted relative to the frame so as to provide quick and easy access to the space between the two panes, but which also presents all of the advantages of sealed closure and of thermal insulation to be found in the first type of oven door.

In a manner known from document GB 451 702, the oven door comprises:

a frame on which two panes are mounted that are parallel and spaced apart from each other, and inside pane being hinge-mounted relative to the frame by means of a hinge piece; and rapid-action locking and unlocking closure means situated remote from the hinge axis of the inside pane and enabling the inside pane to be held in a closed position relative to the frame.

According to the invention, the closure means comprise one or more point spacers providing rapid-action locking and unlocking closure, and which enable the distance of the inside pane to be maintained relative to the inside face of the frame when the inside pane is closed; the hinge piece includes at least one plate; and the inside pane is fixed at a distance from said plate by at least one fixing point spacer in such a manner that when said inside pane is in its closed position said plate engages and bears against the inside face of the frame.

In a preferred variant, one end of each fixing point spacer passes through each corresponding plate of the hinge piece, and the inside face of the frame includes an opening for passing said end, such that each plate of the hinge piece presses and positions itself accurately against said inside face of the frame. Advantageously, this variant makes it possible to ensure that the inside pane is always identically positioned in the closed position relative to the inside face of the frame of the door, and thus to ensure that the pane is always identically positioned relative to the muffle of the oven.

BRIEF DESCRIPTION OF THE DRAWINGS

Other characteristics and advantages of the invention appear from the following description of a particular embodiment of an oven door of the invention given by way of non-limiting example and with reference to the accompanying drawings, in which.

MORE DETAILED DESCRIPTION

Figure 1:
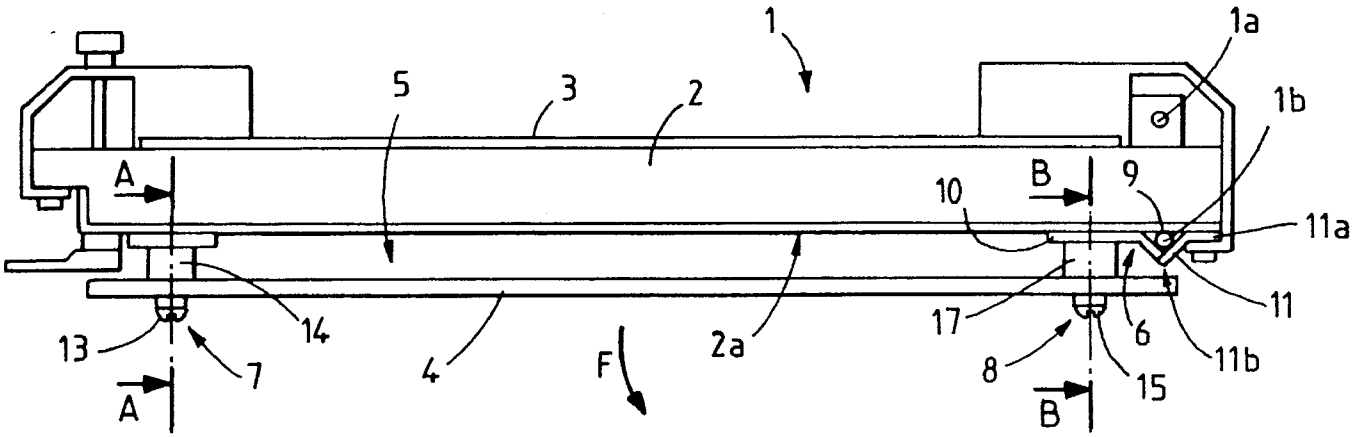
FIG. 1 is a plan view of an oven door of the invention.

The oven door 1 of the invention which is shown in FIG. 1 comprises a hollow metal frame 2 that is substantially rectangular in shape and on which there are mounted in parallel an inside pane 4 and an outside pane 3. The outside pane 3 is mounted directly in the frame 2. The inside pane 4 is fixed and held at a distance from the inside face 2*a* of the frame 2 firstly so as to thermally insulate the outside pane 3 and the frame 2 from the inside pane 4, and secondly so as to leave a space 5 between the frame 2 and the inside pane 4 large enough to act as a ventilation passage by natural convection of ambient air. When the door 1 is fitted to an oven (not shown), it is hinge-mounted about a vertical hinge axis 1*a*. In this case, when the door is closed, the outside pane 3 faces the user of the oven; and the inside pane 4 bears against the muffle of the oven so as to ensure sealed closure thereof via a sealing gasket that surrounds the opening in the muffle of the oven.

The oven door 1 includes a hinge piece 6 which is pivotally mounted on the inside face 2*a* of the frame 2 about a hinge axis 1*b*, which in the particular example of FIG. 1 is parallel to the hinge axis 1*a* of the door 1. The inside pane 4 is fixed firstly directly to the inside face 2*a* of the frame 2 via two point spacers 7 for closure purposes that can be quickly locked and unlocked and that are situated remote from the hinge axis 1*b*, and secondly to the hinge piece 6 via two point spacers 8 for fixing purposes.

Figure 3:
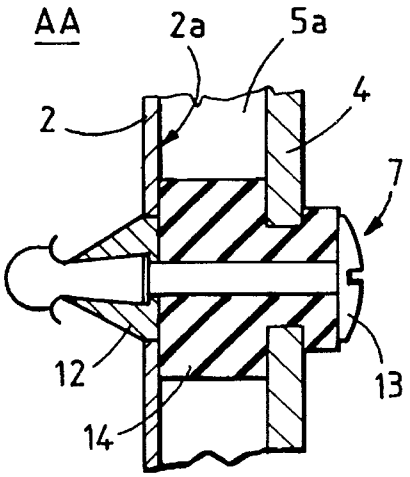
FIG. 3 is a section view on plane AA showing a point spacer for closing the door of FIG. 1.
Figure 2:
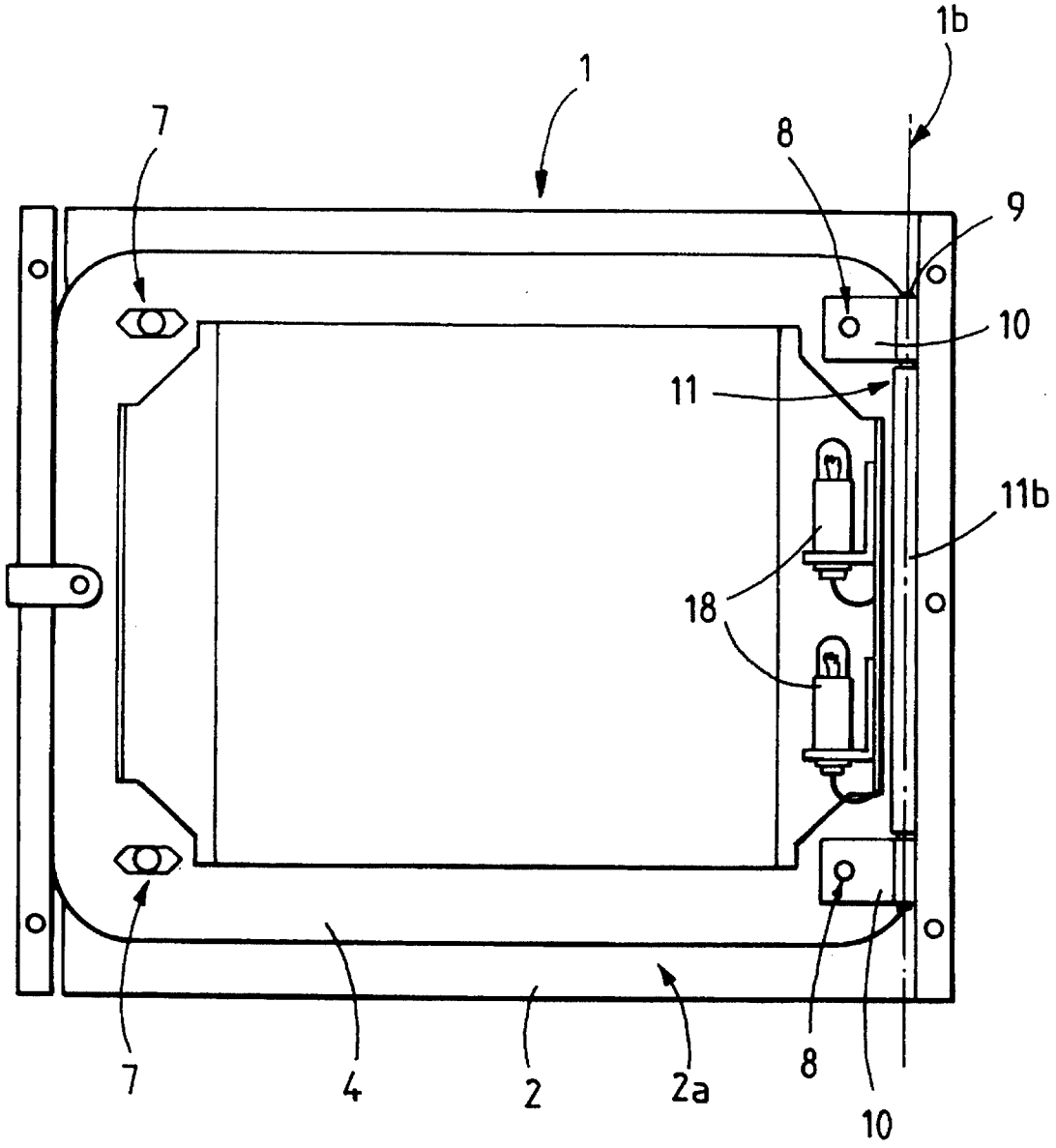
FIG. 2 is a front view of the FIG. 1 door.

As can be seen in FIGS. 2 and 3, each closure point spacer 7 comprises an assembly of a locking ring 12 and a quarter-turn screw 13. The two quarter-turn screws 13 are fixed through the inside pane 4, close to respective corners of said pane that are both remote from its hinge axis 1*b*. The two locking rings 12 are spring clips for quarter-turn screws that are fixed directly to the inside face 2*a* of the frame so that each of the quarter-turn screws 13 engages in the corresponding locking ring 12 when the inside pane is in its closed position, as shown in FIG. 1. Each assembly comprising a locking ring 12 and a quarter-turn screw 13 also includes a rubber sealing gasket 14. The rubber gasket 14 surrounds the corresponding quarter-turn screw 13 and passes through the inside pane 4 so as to bear against the inside face 2*a* of the frame 2 when the inside pane 4 is closed (FIG. 3). Its function is thus firstly to provide sealing where the quarter-turn screw 13 passes through the inside pane 4, and secondly to act as a spacer between the inside face 2*a* of the frame 2 and the inside pane 4.

Figure 5A:
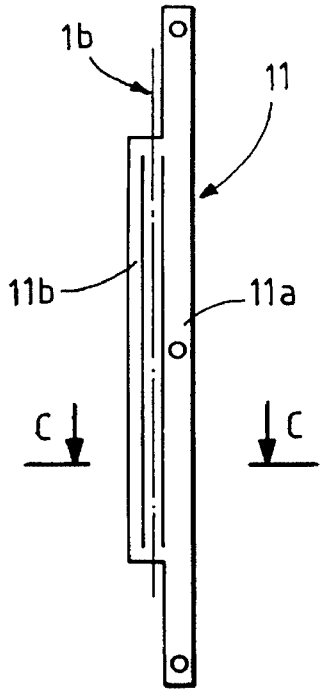
FIG. 5A is a front view of the part enabling the hinge piece to be fixed on the frame of the door of FIG. 1.
Figure 5B:
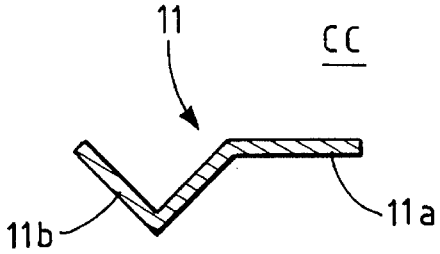
FIG. 5B is a section view on plane CC through the part of FIG. 5A.
Figure 6A:
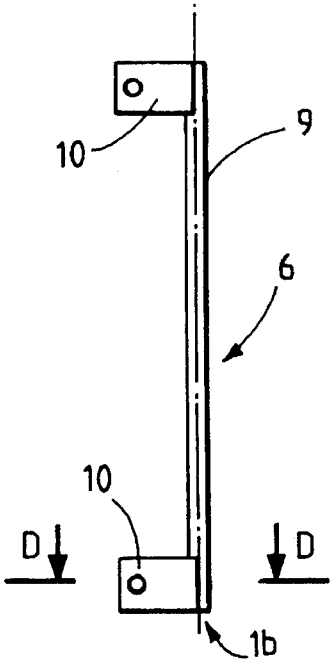
FIG. 6A is a front view of the hinge piece of the odor of FIG. 1.
Figure 6B:
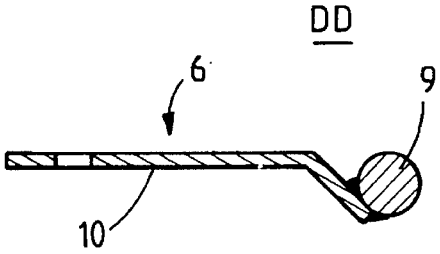
FIG. 6B is a section view on plane DD through the hinge piece of FIG. 6A.

With reference to FIGS. 6A and 6B, the hinge piece 6 is constituted by a metal rod 9 having two identical plates 10 that lie in a common plane fixed to respective ends thereof, e.g. by welding, the plates being rectangular in shape and narrow in width relative to the length of the rod 9. The rod 9 of the hinge piece 6 of the door 1 is mounted to pivot about the hinge axis 1*b* via the part 11 shown in FIGS. 5A and 5B. This part 11 includes a plane portion 11*a* which is designed to be fixed to the inside face 2*a* of the frame 2 by means of three screws, and a portion 11*b* which is in the form of a de-section trough (FIG. 5B) and which is designed to serve as a housing for the rod 9 of the hinge piece 6 while said part 11 is fixed on the frame 2.

Figure 4:
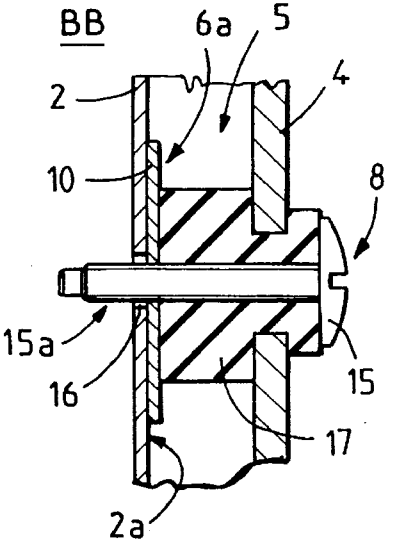
FIG. 4 is a section view on plane BB showing a point spacer for fixing the oven door of FIG. 1.

As can be seen in FIGS. 2 and 4, the two fixing point spacers 8 are constituted by two screws 15 that pass through the inside window 4 and through respective ones of the plates 10 of the hinge piece 6. A rubber sealing gasket 17 is also provided for each screw 15. An opening 16 is provided through the inside face 2*a* of the frame 2 level with each of the two plates 10 of the hinge piece 6 in order to pass the ends 15*a* of the respective screws 15 which are situated on the other side of the plate 10 relative to the inside pane 4. Thus, when the inside pane 4 is in the closed position (FIG. 1), the plates 10 press accurately over their full areas against the inside face 2*a* of the frame 2 of the door 1, and the inside pane 4 is always properly positioned relative to the frame 2. As a result, in an oven which is fitted with the door 1 and which is closed by the inside pane 4 co-operating with a sealing gasket that is fixed either around the periphery of the pane or else around the periphery of the oven opening, the inside pane 4 is always properly positioned relative to said sealing gasket, and always bears accurately thereagainst when the door 1 is in its closed position, thereby making it possible to obtain optimum sealed closure of the oven.

The door of the invention also makes it possible to obtain very good thermal insulation of the outside pane 3 and of the frame 2 relative to the inside pane 4. For the door 1 as described above, this thermal insulation is increased by the facts that the number of points of contact between the inside pane 4 and the inside face 2*a* of the frame 2 has been restricted to four, and that the area of each of these contact points is voluntarily selected to be as small as possible, being constituted in particular by the area of the plates 10.

To access the space situated between the two panes 3 and 4, it suffices to unlock the two screws 13 by causing each of them to rotate through one-fourth of a turn, and then to open the inside pane 4 by causing it to pivot in the direction of arrow F (FIG. 1) about the hinge axis 1*b*. It is therefore no longer necessary to dismount the inside pane 4 completely. Operations of cleaning the inside faces of the two panes 3 and 4 and the inside of the frame 2 are thus facilitated. In addition, when the space is used to house oven lighting, as illustrated in FIG. 2 by the lamps 18, a lamp that is no longer working can be changed very quickly. To close the inside pane 4, it suffices to pivot it in the direction opposite to the arrow F until the plates 10 bear against the frame 2, and until the screws 13 are engaged in their respective locking rings 12, after which the screws 13 can be locked in place by rotating each of them back through one-fourth of a turn in the opposite direction to that used for unlocking them. The pane is then again ready for use for sealed closure of the oven on which the door 1 is mounted.

The invention is not limited to the description of the particular embodiment that has been given by way of non-limiting example. In particular, it would be possible to design a hinge piece of a different shape, e.g. constituted by a single plate replacing the two small-sized plates 10 and extending over the entire length of the rod 9. It would also be possible to use a larger number of screws 15 or a larger number of locking ring and quarter-turn screw assemblies, without thereby going beyond the ambit of the invention. The hinge axis of the inside pane could optionally be horizontal.

I claim:

1. An oven door comprising:

a frame on which an inside pane and an outside pane are mounted that are parallel and spaced apart from each other, said inside pane being hinge-mounted relative to the frame by means of a hinge piece and pivotable about a hinge axis thereof along one of four side edges of the inside face of the frame; and rapid-action locking and unlocking closure means situated remote from the hinge axis of the inside pane and enabling the inside pane to be held in a closed position relative to the frame;

wherein the closure means comprise one or more point spacers providing rapid-action locking and unlocking closure, said point spacers capable of maintaining a space between the inside pane and the inside face of the frame when the inside pane is closed, wherein the hinge piece includes at least one plate, and wherein the inside pane is fixed at a distance from said plate by at least one fixing point spacer in such a manner that when said inside pane is in the closed position said plate engages and bears against the inside face of the frame.

2. An oven door according to claim 1, wherein the hinge piece includes at least two small-sized plates, and wherein the inside pane is fixed to each plate by means of a respective single fixing point spacer.

3. An oven door according to claim 1, wherein one end of each fixing point spacer passes through each corresponding plate of the hinge piece, and wherein the inside face of the frame includes an opening for passing said end, such that each plate of the hinge piece presses and positions itself accurately against said inside face of the frame.

4. An oven door according to claim 1, wherein each closure point spacer comprises a clip type locking ring which is fixed to the frame of the door, and a quarter-turn screw which is secured to the inside pane so as to co-operate with the locking ring when the inside pane is in its closed position.

* * * * *